US006795673B2

(12) United States Patent
Yoshizawa

(10) Patent No.: US 6,795,673 B2
(45) Date of Patent: Sep. 21, 2004

(54) DEVELOPING CARTRIDGE AND IMAGE FORMING APPARATUS USING THE SAME

(75) Inventor: Hideo Yoshizawa, Saitama (JP)

(73) Assignee: Ricoh Company Ltd., Tokyo (JP)

( * ) Notice: Subject to any disclaimer, the term of this patent is extended or adjusted under 35 U.S.C. 154(b) by 0 days.

(21) Appl. No.: 10/422,839

(22) Filed: Apr. 25, 2003

(65) Prior Publication Data

US 2003/0231906 A1 Dec. 18, 2003

(30) Foreign Application Priority Data

Apr. 25, 2002 (JP) ..... 2002-123762
Apr. 9, 2003 (JP) ..... 2003-105112

(51) Int. Cl.[7] ..... G03G 15/08; G03G 21/16
(52) U.S. Cl. ..... 399/284; 399/111; 399/281
(58) Field of Search ..... 399/269, 265, 399/272, 274, 279, 281, 284, 112, 111

(56) References Cited

U.S. PATENT DOCUMENTS 4,131,357 A * 12/1978 Forbes, 2nd ..... 399/269
4,378,158 A * 3/1983 Kanbe ..... 399/281
5,017,967 A * 5/1991 Koga ..... 399/265
5,170,213 A * 12/1992 Yamaguchi et al. ..... 399/281
5,298,948 A * 3/1994 Kurisu ..... 399/279
5,373,353 A * 12/1994 Fukasawa ..... 399/284
5,548,383 A * 8/1996 Endoh ..... 399/284
5,765,079 A 6/1998 Yoshiki et al.
5,794,108 A 8/1998 Yoshizawa et al.
5,970,290 A 10/1999 Yoshiki et al.
6,198,895 B1 3/2001 Tsuda et al.
6,321,057 B1 * 11/2001 Yamamoto ..... 399/281
6,337,957 B1 1/2002 Tamaki et al.
6,347,208 B1 * 2/2002 Yamamoto ..... 399/281
6,522,855 B1 2/2003 Katoh et al.
6,553,202 B2 4/2003 Tamaki et al.

OTHER PUBLICATIONS

U.S. patent application Ser. No. 09/715,126, Endoh et al., filed Nov. 20, 2000, US pat. No. 6,643,486.
U.S. patent application Ser. No. 09/875,034, Endoh et al., filed Jun. 7, 2001, US PG Pub 20020012553.
U.S. patent application Ser. No. 10/625,505, Murakami et al., filed Sep. 2, 2003.
U.S. patent application Ser. No. 10/660,620, Murakami et al., filed Sep. 12, 2003.
U.S. patent application Ser. No. 10/665,825, Yoshizawa et al., filed Sep. 22, 2003.
U.S. patent application Ser. No. 10/703,447, Yoshiyuki et al., filed Nov. 10, 2003.

* cited by examiner

*Primary Examiner*—Susan Lee
(74) *Attorney, Agent, or Firm*—Oblon, Spivak, McClelland, Maier & Neustadt, P.C.

(57) ABSTRACT

A developing device for an image forming apparatus of the present invention includes a developer carrier for depositing toner on a latent image formed on an image carrier to thereby produce a toner image. A toner feeding member is rotatable in contact with the developer carrier to thereby feed the toner to the developer carrier. A metering member contacts the developer carrier for metering the toner deposited on the developer carrier while a regulating member regulates the toner deposited on the toner feeding member. During development, the developer carrier is rotated such that its surface moves vertically upward at a position where the surface faces an image carrier, while the toner feeding member is rotated such that its surface moves in the same direction as the surface of the developer carrier at a position where the toner feeding member faces the developer carrier.

12 Claims, 8 Drawing Sheets

DEVELOPING CARTRIDGE AND IMAGE FORMING APPARATUS USING THE SAME

BACKGROUND OF THE INVENTION

1. Field of the Invention

The present invention relates to a copier, printer, facsimile apparatus or similar electrophotographic or electrostatic image forming apparatus and more particularly to a developing cartridge for use in such an image forming apparatus.

2. Description of the Background Art

One of conventional developing devices for use in an image forming apparatus includes a developing cartridge formed with an opening that faces a photoconductive belt or image carrier. An inlet seal is positioned in the opening of the cartridge for preventing toner from leaking via the opening. A developing roller is rotatable in contact with the belt while a feed roller is rotatable to feed toner to the developing roller. The developing device uses a nonmagnetic, single-ingredient type developer, i.e., toner.

In the developing device of the type described, the developing roller is rotated such that its surface moves upward in the cartridge while the feed roller is rotated in the opposite direction to the developing roller. The feed roller should therefore be positioned in the upper portion of the cartridge. The feed roller so positioned scrapes toner left on the developing roller upward with the result that the toner accumulates in the upper portion of the cartridge. The toner thus accumulated presses the inlet seal to thereby produce a clearance between it and the developing roller, causing the toner to spurt out via the opening of the cartridge.

To prevent the toner from spurting out, the feed roller may be rotated in the same direction as the developing roller so as to scrape the toner left on the developing roller downward, as proposed in the past. This, however, brings about another problem that excessive toner is transferred from the feed roller to the developing roller, degrading the charging ability of the toner and thereby rendering, e.g., a solid image defective. Moreover, the excessive toner also presses the inlet seal and thereby produces the opening mentioned above.

SUMMARY OF THE INVENTION

It is an object of the present invention to provide a developing cartridge capable of preventing excessive toner from being transferred from a feed roller to a developing roller and capable of preventing toner accumulated in the upper portion of the cartridge from leaking.

A developing device of the present invention includes a developer carrier for depositing toner on a latent image formed on an image carrier to thereby produce a toner image. A toner feeding member is rotatable in contact with the developer carrier to thereby feed the toner to the developer carrier. A metering member contacts the developer carrier for metering the toner deposited on the developer carrier while a regulating member regulates the toner deposited on the toner feeding member. During development, the developer carrier is rotated such that its surface moves vertically upward at a position where the surface faces an image carrier, while the toner feeding member is rotated such that its surface moves in the same direction as the surface of the developer carrier at a position where the toner feeding member faces the developer carrier.

An image forming apparatus using the above developing device is also disclosed.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
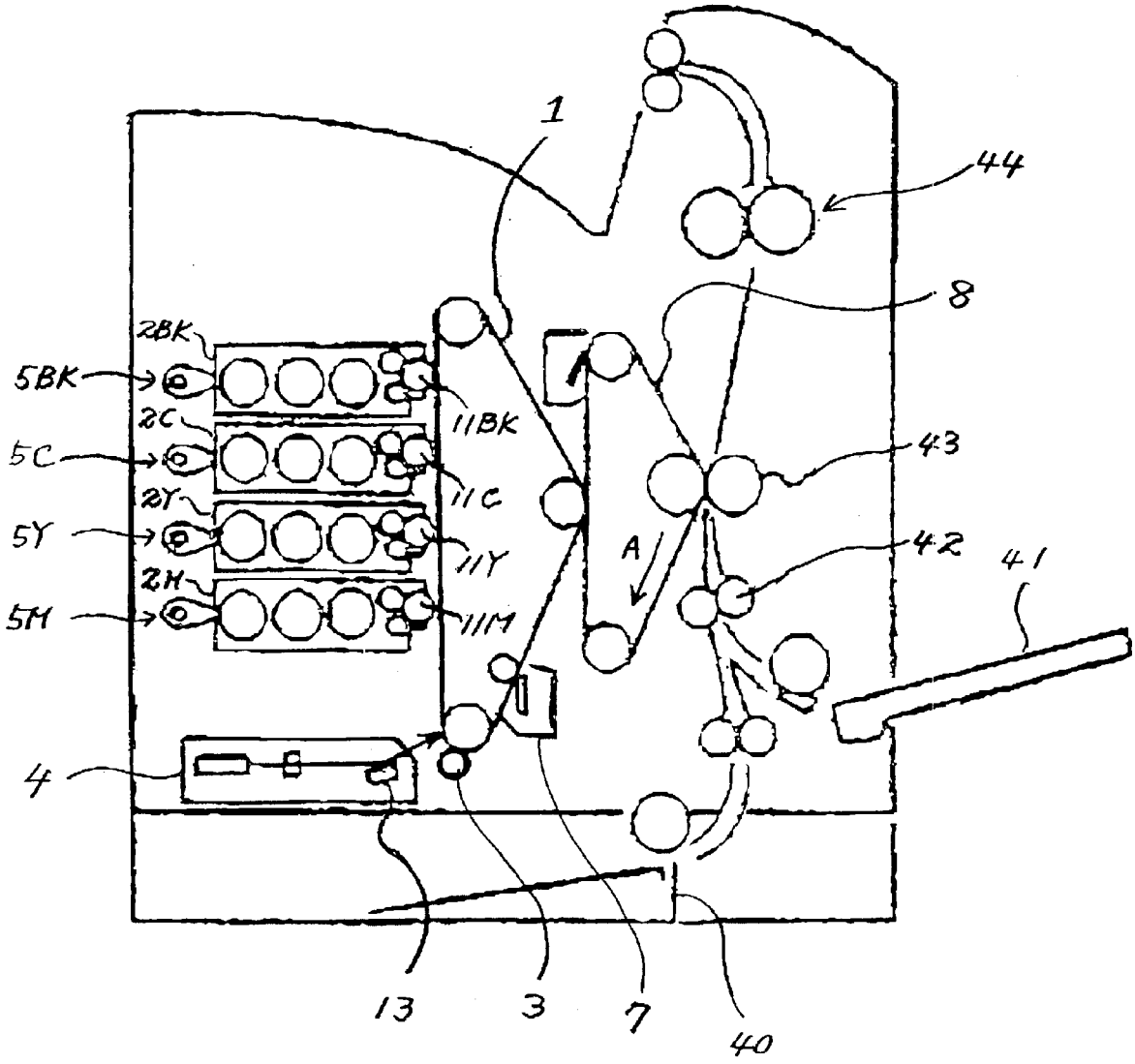
FIG. 1 PRIOR ART
FIG. 1 is a view showing a specific construction of a conventional image forming apparatus.

To better understand the present invention, brief reference will be made to a specific construction of a conventional image forming apparatus, shown in FIG. 1. As shown, the image forming apparatus includes a photoconductive belt or image carrier 1 passed over a plurality of rollers and movable in a direction indicated by an arrow A (clockwise). An organic photoconductive layer is formed on the outer surface of the photoconductive belt (simply belt hereinafter) 1. Arranged around the belt 1 are a charger 3, an optical writing unit 4 including a mirror 13, four developing means 5BK (black), 5C (cyan), 5M (magenta) and 5Y (yellow), an intermediate image transfer belt 8, belt cleaning means 7, and so forth. The developing means 5BK through 5Y each use a nonmagnetic, single-ingredient type developer, i.e., toner.

Figure 2:
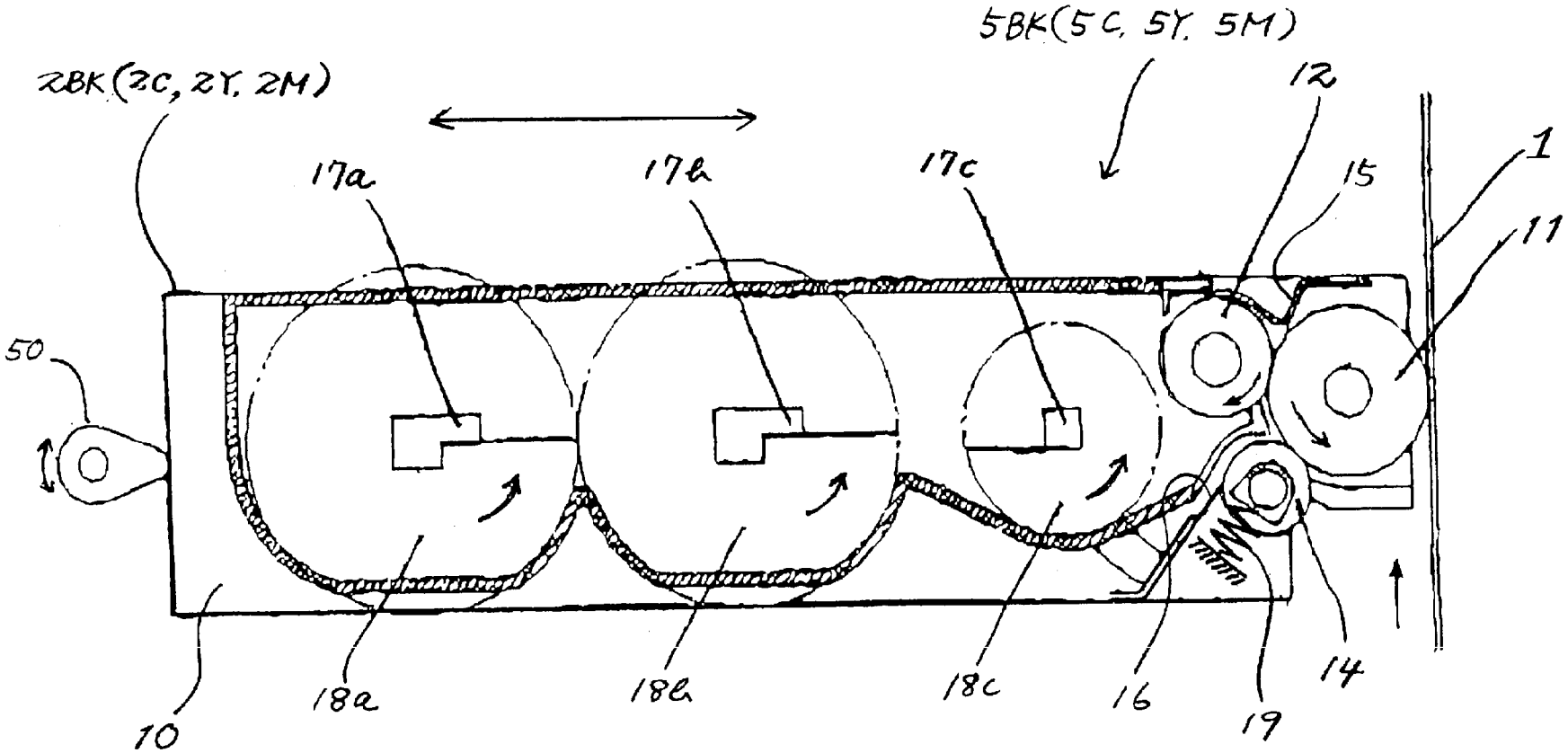
FIG. 2 PRIOR ART
FIG. 2 is a section showing a developing cartridge included in the conventional image forming apparatus.

The image forming means 5BK through 5Y are generally identical in configuration except for the color of toner to use. FIG. 2 shows the configuration of the image forming means BK by way of example in an enlarged view. As shown, the image forming means 5BK includes a developing cartridge 2BK (2C, 2Y, 2M) formed with an opening facing the belt 1. The developing cartridge 2BK accommodates a developing roller or developer carrier 1, a feed roller or rotatable toner feeding member 12 for feeding toner to the developing roller 11, agitators 17*a*, 17*b* and 17*c*, and a doctor roller or metering member 14. The agitator 17*a* through 17*c* respectively convey toner stored in toner storing portions 18*a*, 18*b* and 18*c*, which are formed in a casing 10, toward the feed roller 12 while agitating the toner.

The doctor roller 14 is held in contact with the developing roller 1 for metering the toner fed from the feed roller 12 to the developing roller 11, causing the toner to form a thin layer having preselected thickness. A housing accommodating a one-way clutch, not shown, is mounted on one end of the doctor roller 14. The one way clutch prevents the doctor roller 14 from rotating when the developing roller 11 is rotated in the forward direction during image formation. When the developing roller 11 is rotated in the reverse direction, the one-way clutch causes the doctor roller 14 to freely rotate by following the rotation of the developing roller 11.

More specifically, the developing roller 11 is partly exposed via the opening of the developing cartridge 2BK (2C, 2M, 2Y) and rotated, during development, in a direction indicated by an arrow in FIG. 2 (counterclockwise) at a preselected linear velocity. The developing roller 11 in rotation coveys the toner deposited thereon to a developing position where the roller 11 faces the belt 1, thereby developing a latent image formed on the belt 1.

The agitators 17*a* through 17*c* each are rotated in a direction indicated by an arrow in FIG. 2 (counterclockwise) to thereby convey the toner toward the feed roller 12. The agitators 17*a* through 17*b* each may be formed of polypropylene or similar soft, elastic material, so that each agitator can surely convey the toner in contact with the inner periphery of the developing cartridge 2BK (2C, 2M, 2Y).

During image formation, the doctor roller 14 does not rotate, as stated above, and meters the toner deposited on the developing roller 11 while charging the toner by triboelectrification. The toner thus charged is transferred from the developing roller 11 to the belt 1 to thereby develop a latent image formed on the belt 1. A cleaning blade 16 is held in contact with the doctor roller 14 in order to clean the surface of the roller 14 moved away from the developing position.

A spring or biasing means 19 constantly presses the doctor roller 14 against the developing roller 11 in order to cope with varying environmental conditions including humidity. An inlet seal 15 is fitted on the inner periphery of the developing cartridge 2BK such that the edge of the inlet seal 15 contacts the developing roller 11 for thereby preventing the toner from leaking via the clearance between the roller 11 and the developing cartridge 2BK.

A cam 50 is positioned at one side (left-hand side in FIG. 2) of the developing means 5BK and rotatable independently of the other cams 50 assigned to the developing means 5C, 5M and 5Y. The cam 50 is rotated by 180° such that the developing means 5BK is released from the belt 1 when not operating or brought into contact with the belt 1 when operating. This is also true with the other developing means 5C, 5M and 5Y.

The conventional image forming apparatus has the following problem left unsolved. As shown in FIG. 2, the surface of the developing roller 11, contacting the belt 1, moves from the lower portion to the upper portion of the developing means 5BK while the feed roller 12 is positioned at the upper portion of the developing means 5BK. In this configuration, if the feed roller 12 is rotated in the opposite direction to the developing roller 11, as in the conventional developing device of the type using a single-ingredient type developer, then the feed roller 12 must be positioned at the upstream portion of the developing means 5BK. Consequently, the surface of the feed roller 12 moves in a direction in which it scrapes the toner left on the developing roller 11 upward. When the toner scraped upward accumulates in more than a preselected amount, toner pressure acts on the inlet seal 15 due to the feed roller 12 and produces a clearance between the inlet seal 15 and the developing roller 1, causing the toner to spurt out via the clearance.

In light of the above, it has been proposed to rotate the feed roller 12 in the same direction as the developing roller 11 and cause the feed roller 12 to scrape the toner left on the developing roller 11 downward, thereby preventing the toner from spurting out. This scheme, however, gives rise to another problem that a force that rubs the toner against the developing roller 11 is weak. As a result, if an excessive amount of toner is transferred from the feed roller 12 to the developing roller 11, then the ability of the developing roller 11 to rub and charge the toner becomes too low to obviate, e.g., defective solid images, as determined by experiments. Further, the excessive toner stays at the position where the feed roller 12 and developing roller 11 contact each other, again resulting in the problem ascribable to toner pressure.

Figure 3:
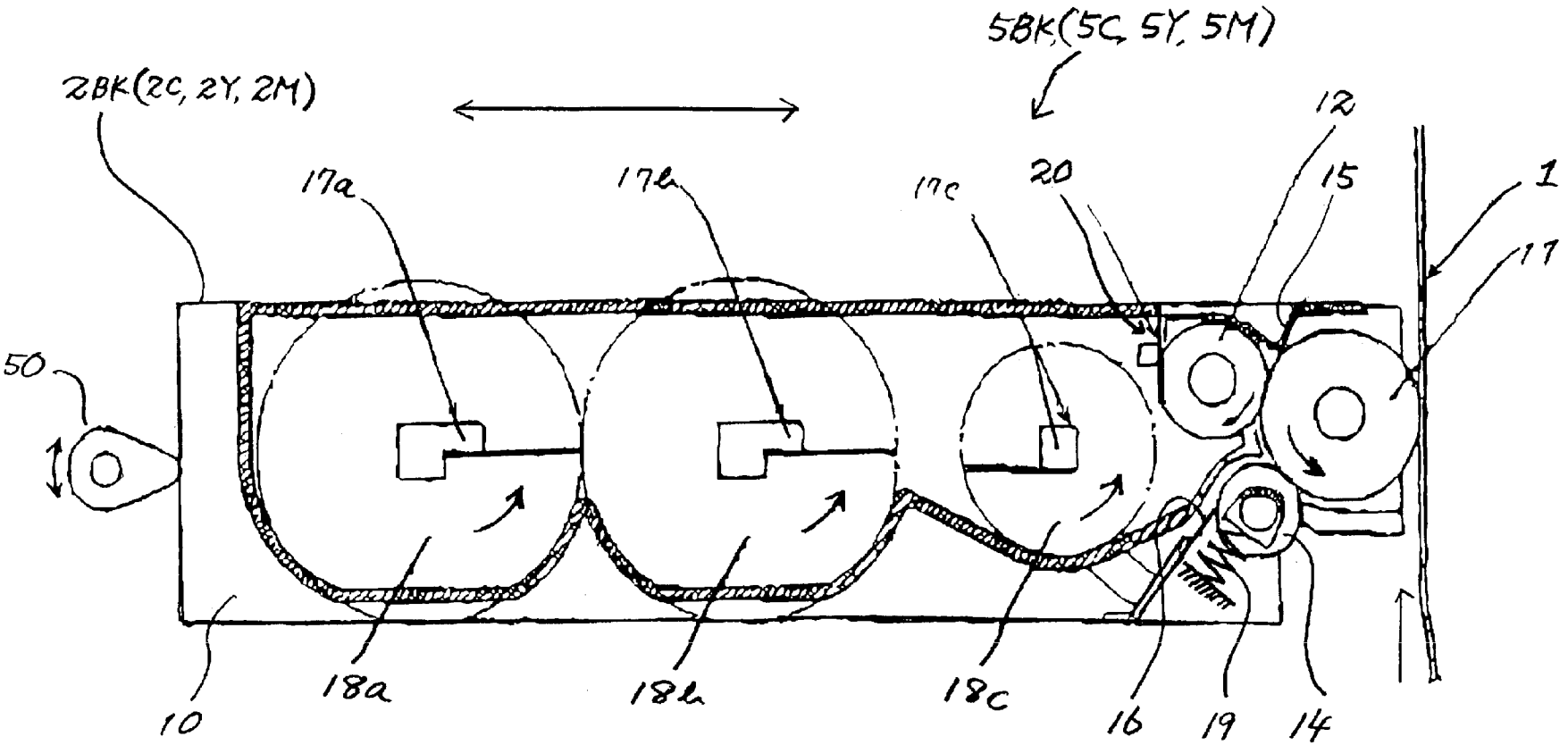
FIG. 3 is a section showing a developing cartridge embodying the present invention and applied to the construction of FIG. 1.
Figure 4:
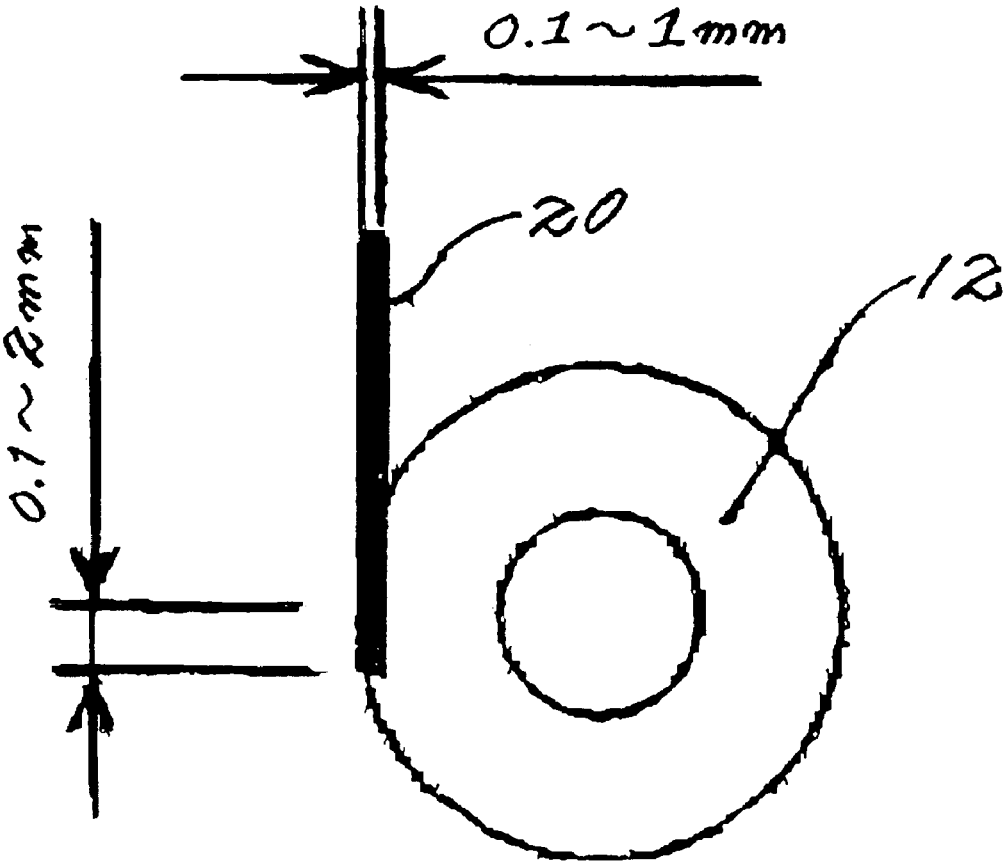
FIG. 4 shows a specific positional relation between a feed roller and a regulating member included in the illustrative embodiment.

Referring to FIGS. 3 and 4, an image forming apparatus embodying the present invention will be described. The image forming apparatus of the illustrative embodiment is generally similar to the image forming apparatus of FIG. 1 and includes image forming means substantially identical with the image forming means of FIG. 2 each. The illustrative embodiment will therefore be described with reference to FIGS. 1, 3 and 4 with identical reference numerals being attached to identical structural elements.

In the illustrative embodiment, as shown in FIG. 1, the charger 3 uniformly charges the belt 1 by being applied with a high voltage. A signal processor, not shown, converts color image data, e.g., four-color image signals received from a computer to BK, C, M and Y image data and sends such image data to the optical writing unit 4. The optical writing unit 4 controls lasers or light sources in accordance with the BK, C, M and Y image data to thereby scan the charged surface of the belt 1 via an f-θ lens, not shown, and the mirror 13. As a result, latent images corresponding to the BK, C, M and Y image data, respectively, are sequentially formed on the surface of the belt 1.

Each of the latent images formed on the belt 1 is developed by one of the developing means 5BK through 5Y each storing toner of particular toner, which has been charged to polarity opposite to the polarity of the toner image. Consequently, BK, C, M and Y toner images are sequentially formed on the belt 1. At the position where the belt 1 and intermediate image transfer belt 6 contact each other, the BK, C, M and Y toner images are sequentially transferred from the belt 1 to the belt 6 one above the other, completing a color image, i.e., four-color toner image on the belt 6.

A sheet or recording medium is fed from either one of a sheet cassette 40 and a manual feed tray 41 by a roller pair 42. The color image is transferred from the intermediate image transfer belt 6 to the sheet by an image transfer roller or secondary image transfer member 43. Subsequently, the sheet carrying the color image thereon is conveyed to a fixing roller pair 44 included in a fixing unit. The fixing roller pair 44 fixes the toner image on the sheet with heat and pressure.

In the illustrative embodiment, the feed roller or rotatable toner feeding member 12 is pressed against the developing roller 11 by preselected pressure. The surface of the feed roller 12 is formed of foam polyurethane having hardness of 75±10° in ASKER FP scale and seventy or more cells for 25 mm. Further, the feed roller 12 is provided with electric resistance of $10^{9.2\pm1}$ Ω and is barrel-shaped to be uniformly pressed against the developing roller 11 in the axial direction. As shown in FIG. 3, a regulating member 20 is positioned upstream of the position where the feed roller 12 contacts the developing roller 11, and is implemented by a flexible sheet. The regulating member 20 prevents the toner from leaking from the upper portion of the feed roller 12.

Further, the regulating member 20 is expected to block excess toner in contact with the feed roller 12 and should need a minimum of contact pressure. For this purpose, in the illustrative embodiment, the regulating member 20 is implemented by a resilient or a flexible sheet. As shown in FIG.

4, the regulating member 20 bites into the feed roller 12 by an amount of 0.1 mm to 1 mm from the surface of the feed roller 12 in the radial direction. In this condition, the regulating member 20 can effectively scrape off the toner deposited on the feed roller 12.

While the regulating member 20 must be held in contact with the feed roller 12 to achieve the functions stated above, excessive contact would increase torque load and would result in excessive scrape-off. In light of this, as also shown in FIG. 4, the regulating member or flexible sheet 20 should preferably protrude from the center of the feed roller 12 by 0.1 mm to 1 mm in the tangential direction.

If the regulating member 20 does not protrude from the center of the feed roller 12 in the radial direction of the feed roller 12, then the regulating member 20 is likely to bite into the feed roller 12 in the direction of rotation of the feed roller 12 and damage it. On the other hand, if the regulating member 20 is excessively long, then it is likely to interfere with the rotatable portion of the agitator 17*c*. To solve this problem, as shown in FIG. 4, the regulating member 20 is so configured as to protrude from the center of the feed roller 12 by 0.1 mm to 2 mm in the radial direction of the feed roller 12.

In the illustrative embodiment, the doctor roller 14 has a surface formed of resin-coated urethane rubber. The surface of the doctor roller 14 is provided hardness of 72±4° in JIS-K6253 scale, surface roughness Rz of 4 $\mu$m, and a coefficient of friction of 0.26±0.05. Further, the doctor roller 14 is provided with electric resistance of $10^{4.9\text{-}6.4}$ Ω and is crown-shaped, or arcuate, to be uniformly pressed against the developing roller 11 in the axial direction.

Figure 5:
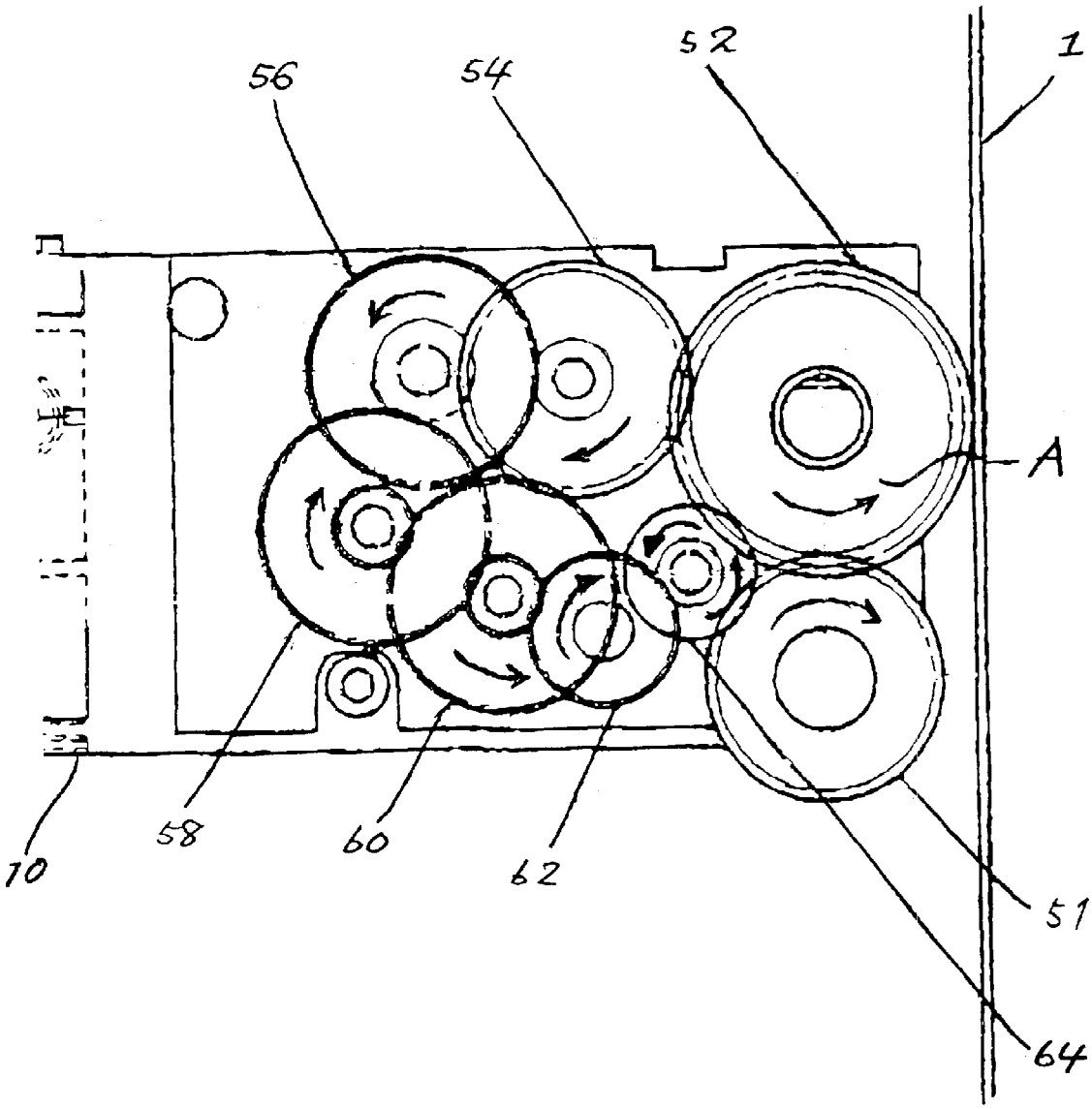
FIG. 5 is a view showing a specific gear train also included in the illustrative embodiment.

In the illustrative embodiment, as in the conventional construction, a one-way clutch is mounted on the shaft of the doctor roller 14. During image formation or development, the doctor roller 14 is held stationary by the one-way clutch for thereby metering the toner deposited on the developing roller 11 while charging the toner by triboelectrification. In the illustrative embodiment, when the developing means 2BK, for example, ends development, the cam 50 assigned to the developing means 2BK is rotated to retract the developing means 2BK. At the same time, a drive gear, not shown, held in mesh with a gear affixed to the shaft of the developing roller 11 is caused to stop rotating. As a result, as shown in FIG. 5 specifically, a force exerted on a developing roller gear 52 by a drive gear 51, which is held in mesh with the gear 52, is canceled with the result that the casing 10 is bodily moved away from the belt 1. At this instant, the developing roller 11 rotates in the reverse direction due to the engagement of the drive gear 51 and developing roller gear 52, causing the doctor roller 14 to rotate. Consequently, impurities accumulated between the developing roller 11 and the doctor roller 14 are removed.

If desired, a spring or similar biasing means may be used to retract the casing 10 away from the belt 1 in place of or in addition to the cancellation of the force of the drive gear 51 acting on the developing roller gear 52. Also, the developing roller 11 may be positively rotated in the reverse direction when image formation is not under way, causing the doctor roller 14 to rotate; the doctor roller 14 may also be positively driven.

The doctor roller 14 may be rotated in the same direction as the developing roller 11 such that the surface of the former and that of the latter contacting each other move in opposite directions to each other. In such a case, the rotation speed of the doctor roller 14 should be far lower than the rotation speed of the developing roller 11. FIG. 4 shows a specific gear train for speed reduction. As shown, torque is transmitted from the drive gear or input gear 50 to the developing roller gear 52; the rotation speed is 200 rpm to 300 rpm. Idle gears 54 through 62 reduce the above rotation speed to about one-thirtieth to one-fiftieth. The resulting torque is transferred to a doctor roller gear 64. In the illustrative embodiment, the doctor roller 14 is movable into and out of contact with the developing roller 11 and pressed against the developing roller 11, as will be described later specifically. To implement this configuration, the doctor roller 14 and doctor roller gear 64 are interconnected by an Oldham coupling or similar mechanism capable of transferring torque even when the axis is shifted. In the gear train of FIG. 5, too, when the drive gear 51 is rotated in the reverse direction, the developing roller 11 and doctor roller 14 are also rotated in the reverse direction.

Figure 6:
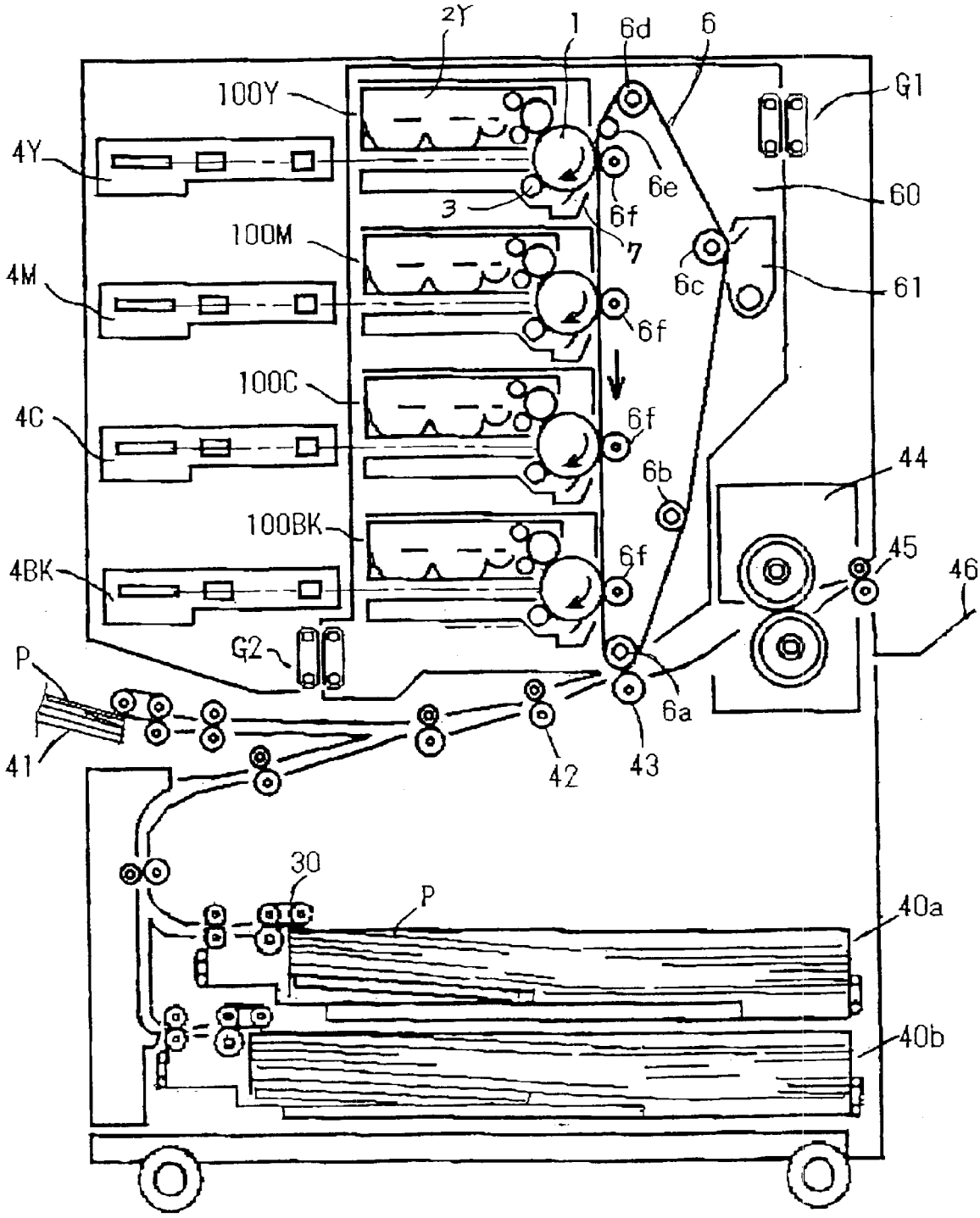
FIG. 6 is a view showing a tandem, color image forming apparatus to which an alternative embodiment of the present invention is applied.
Figure 7:
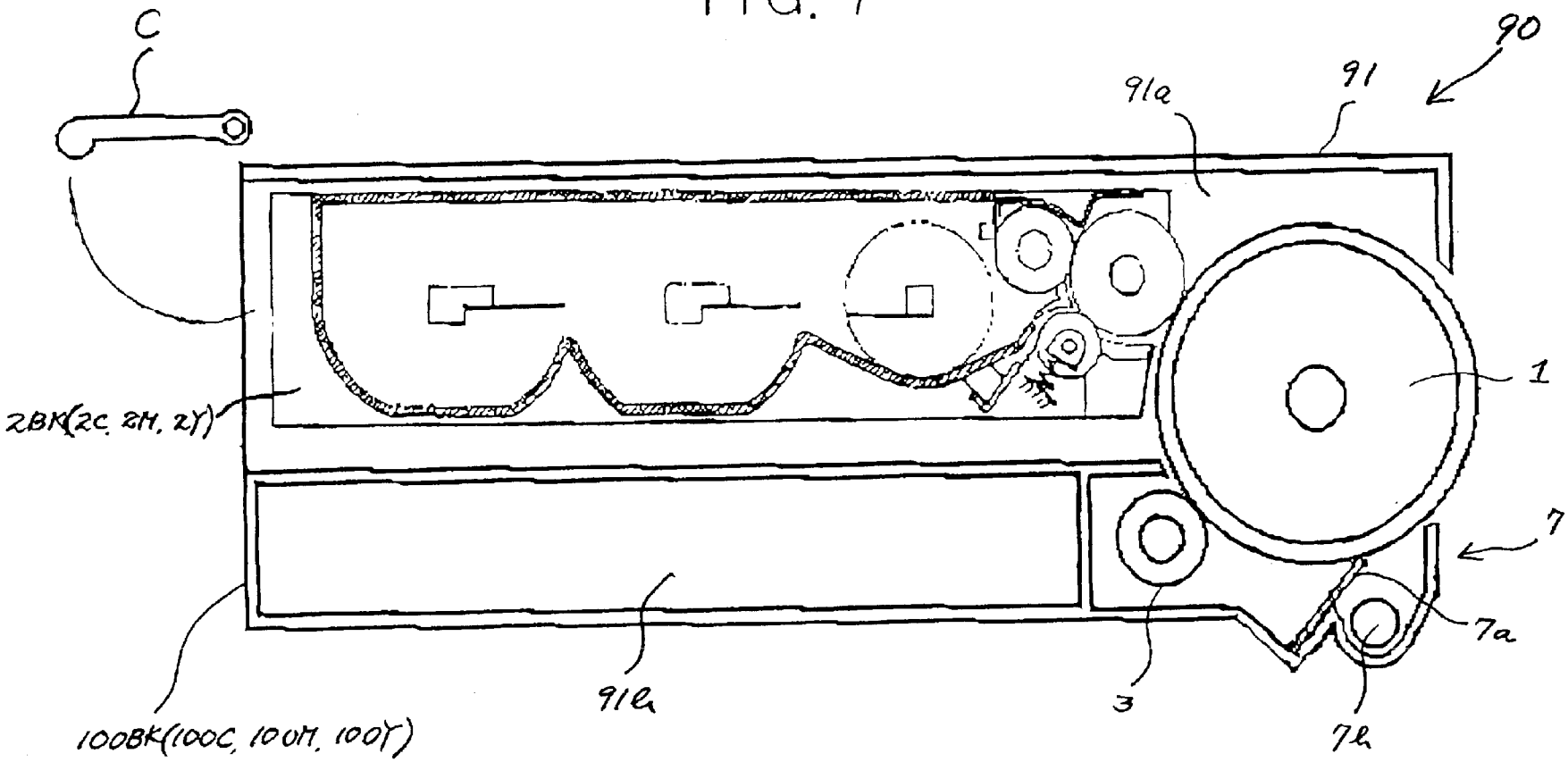
FIG. 7 is a view showing a process cartridge applied to the apparatus of FIG. 6.
Figure 8:
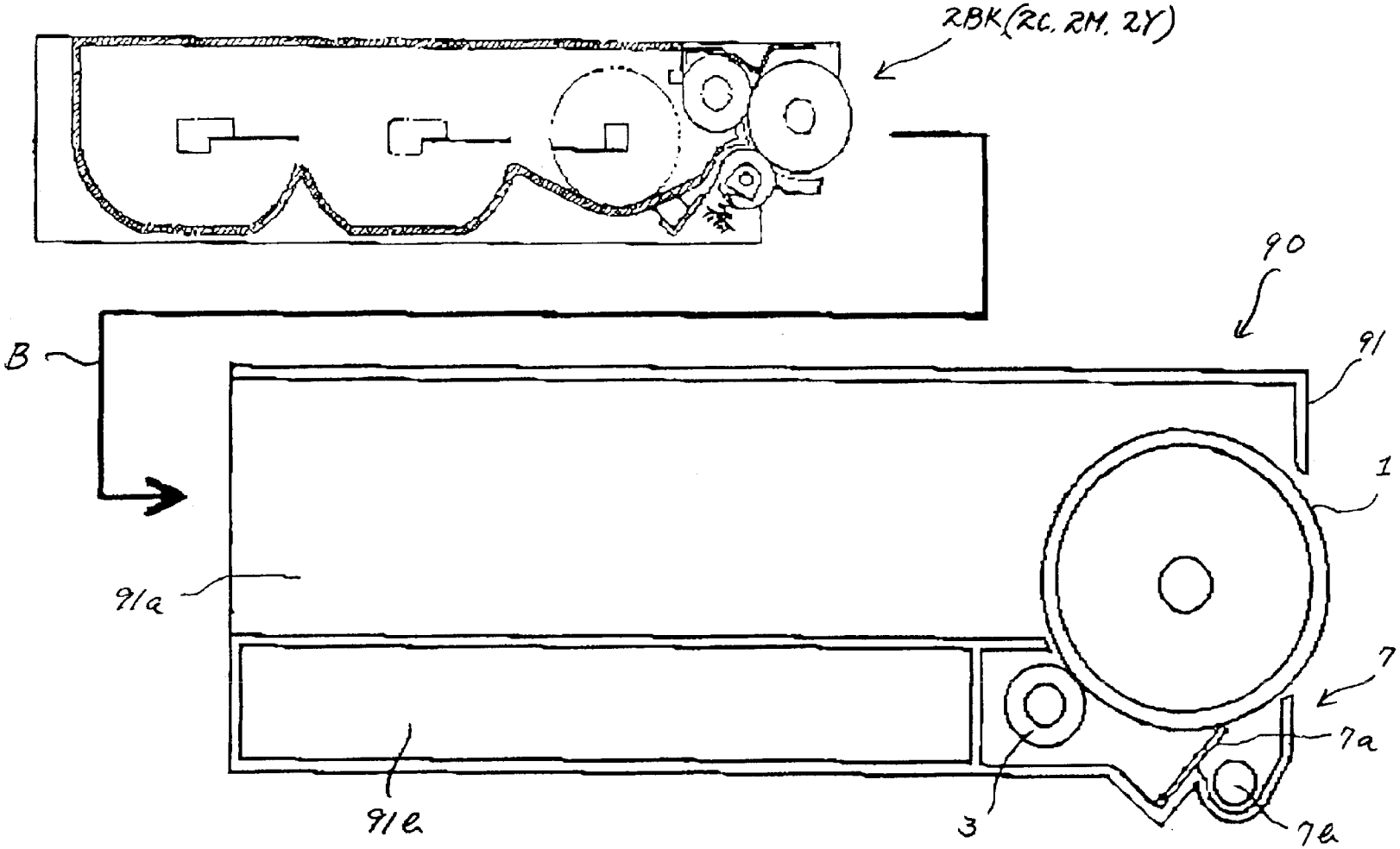
FIG. 8 shows how the process cartridge is assembled.

Reference will be made to FIGS. 6 through 8 for describing an alternative embodiment of the present invention. FIG. 6 shows a tandem, color image forming apparatus including process cartridges 100BK, 100C, 100M and 100Y, which are identical in configuration except for the color of toner to use. FIG. 7 shows one of the process cartridges 100BK through 100Y in detail.

As shown in FIG. 7, a drum unit or image carrier unit 90 includes a frame 91 accommodating a photoconductive drum or image carrier 1, a charge roller 3, and a drum cleaner 7. The developing cartridge 2BK (2C, 2M, 2Y) is removably inserted in a space 91*b* formed in the drum unit 90, as indicated by an arrow B in FIG. 8. The drum cleaner 7 includes a cleaning blade 7*a* and an auger 7*b*. Toner and paper dust and other impurities scraped off by the cleaning blade 7*a* are conveyed by the auger 7*b* to a space 91*b* by a conveying mechanism not shown.

The process cartridge 100BK, for example, is removably mounted to the apparatus body while the developing cartridge 2BK is removably mounted to the frame 91 of the drum unit 90. Further, the developing cartridge 2BK is movable toward and away from the drum 1 and reversible in the direction of rotation. The reverse rotation prevents unnecessary toner from accumulating on the developing roller, as stated earlier. In the illustrative embodiment, a lever C is angularly movable in place of the cam 50 of the previous embodiment so as to move the developing cartridge 2BK toward and away from the drum 1. The lever C is mounted on the apparatus body such that it does not interfere with the process cartridge 100BK when the process cartridge 100BK or the developing cartridge 2BK is mounted or dismounted.

In operation, laser writing units 4Y, 4M, 4C and 4BK each form a latent image on associated one of the uniformly charged surfaces of the drums 1 in accordance with image data of particular color. The process cartridges 100BK through 100Y respectively develop the latent images formed on the drums 1 with Y through BK toner, thereby producing toner images. An intermediate image transfer body is implemented as an endless belt 8 passed over rollers 6*a*, 6*b*, 6*c*, 6*d*, 6*e* and 6*f* and movable in a direction indicated by an arrow in FIG. 6. Image transfer rollers 6, which are applied with biases for image transfer, sequentially transfer the toner images from the drums 1 to the belt 8 one above the other to thereby complete a color image.

A sheet or recording medium P is fed by sheet feeding means 30 at preselected timing and then conveyed by feed roller pairs. The sheet P is fed from a sheet cassette 40*a* or 40*b* or a manual feed tray 41. The sheet cassettes 40*a* and 40*b* each can be pulled out from the apparatus body toward the front in the direction perpendicular to the sheet surface of FIG. 6. A registration roller 43 conveys the sheet P at preselected timing toward an image transfer roller 43. The image transfer roller 43 transfers the color image from the belt 8 to the sheet P. Subsequently, the sheet P is conveyed to a print tray 46 via a fixing unit 44 and an outlet roller pair 45. A belt cleaner 61 removes the toner left on the belt 8 after the image transfer from the belt 8 to the sheet P.

The belt 8 is constructed into a unit and accommodated in an image forming frame 60 together with the process cartridges 100BK through 100Y. Guides G1 and G2 allow the image forming frame 60 to be pulled out from the apparatus body toward the front in the direction perpendicular to the sheet surface of FIG. 6. After the image forming frame 60 has been so pulled out, the process cartridges 100BK through 100Y or the developing cartridges 2BK through 2Y each can be pulled out for replacement or maintenance.

In summary, it will be seen that the present invention provides a developing cartridge and an image forming apparatus having various unprecedented advantages, as enumerated below.

(1) A rotatable toner feeding member is rotated in a preselected direction while a regulating member is associated with the toner feeding member, so that toner is prevented from leaking via a clearance between an image carrier and the casing of a developing device. Further, the regulating member scrapes off excess toner deposited on the toner feeding member to thereby enhance the charging characteristic of the toner while causing the toner to form a thin uniform layer. This provides a solid image with high quality.

(2) When the regulating member is implemented by a flexible sheet, the regulating member is prevented from excessively biting into a feed roller or toner feeding member. This successfully reduces a unit torque load.

(3) The flexible sheet is provided with an adequate length so as not to excessively bite into the feed roller. In addition, the flexible sheet is adequately positioned relative to an agitator.

(4) The developing device or a developing cartridge is removably mounted to an image forming apparatus and can therefore be easily replaced or maintained.

(5) A developing roller is rotatable in the reverse direction when image formation is not under way, so that impurities accumulated between the developing roller and a doctor roller can be returned to a developing unit. This frees an image from white stripes ascribable to the impurities.

Various modifications will become possible for those skilled in the art after receiving the teachings of the present disclosure without departing from the scope thereof.

What is claimed is:

1. A developing device for an image forming apparatus, comprising:

a developer carrier configured to develop a latent image formed on an image carrier by depositing toner to thereby produce a corresponding toner image;

a toner feeding member rotatable in contact with said developer carrier to thereby feed the toner to said developer carrier;

toner conveying means for conveying the toner toward said toner feeding member;

a metering member contacting said developer carrier and configured to regulate an amount of the toner deposited on a surface of said developer carrier by said toner feeding member; and a regulating member configured to regulate an amount of the toner deposited on a surface of said toner feeding member;

wherein, during development, said developer carrier is rotated such that the surface thereof moves vertically upward at a position where said surface faces an image carrier, while said toner feeding member is rotated such that a surface thereof moves in a same direction as said surface of said developer carrier at a position where said toner feeding member faces said developer carrier.

2. The developing device as claimed in claim 1, wherein said regulating member comprises a flexible sheet.

3. The developing device as claimed in claim 2, wherein said toner feeding member comprises an elastic layer while said flexible sheet is so positioned as to bite into said toner feeding member by 0.1 mm to 1 mm from the surface of said toner feeding member in a radial direction.

4. The developing device as claimed in claim 2, wherein said flexible sheet protrudes from a center of said toner feeding member by 0.1 mm to 2 mm in a tangential direction.

5. The developing device as claimed in claim 1, further comprising a casing accommodating said developer carrier, said toner feeding member, said toner conveying means, said metering member, and said regulating member.

6. The developing device as claimed in claim 5, wherein said casing comprises a cartridge removably mounted to a body of the image forming apparatus.

7. In a process cartridge removably mounted to a body of an image forming apparatus and comprising a casing that accommodates a developing device and at least an image carrier, said developing device comprising:

a developer carrier configured to develop a latent image formed on the image carrier by depositing toner to thereby produce a corresponding toner image;

a toner feeding member rotatable in contact with said developer carrier to thereby feed the toner to said developer carrier;

toner conveying means for conveying the toner toward said toner feeding member;

a metering member contacting said developer carrier and configured to regulate an amount of the toner deposited on a surface of said developer carrier by said toner feeding member; and a regulating member configured to regulate an amount of the toner deposited on a surface of said toner feeding member;

wherein, during development, said developer carrier is rotated such that the surface thereof moves vertically upward at a position where said surface faces an image carrier, while said toner feeding member is rotated such that a surface thereof moves in a same direction as said surface of said developer carrier at a position where said toner feeding member faces said developer carrier.

8. The process cartridge as claimed in claim 7, wherein at least said developer carrier of said developing device is movable into or out of contact with said image carrier.

9. In an image forming apparatus using a process cartridge removably mounted to a body of an image forming apparatus and comprising a casing that accommodates a developing device and at least an image carrier, said developing device comprising:

a developer carrier configured to develop a latent image formed on the image carrier by depositing toner to thereby produce a corresponding toner image;

a toner feeding member rotatable in contact with said developer carrier to thereby feed the toner to said developer carrier;

toner conveying means for conveying the toner toward said toner feeding member;

a metering member contacting said developer carrier and configured to regulate an amount of the toner deposited on a surface of said developer carrier by said toner feeding member; and a regulating member configured to regulate an amount of the toner deposited on a surface of said toner feeding member;

wherein, during development, said developer carrier is rotated such that the surface thereof moves vertically upward at a position where said surface faces an image carrier, while said toner feeding member is rotated such that a surface thereof moves in a same direction as said surface of said developer carrier at a position where said toner feeding member faces said developer carrier, and said developer carrier is rotatable in a direction opposite to a direction for image formation when image formation is not under way.

10. The apparatus as claimed in claim 9, wherein at least said developer carrier of said developing device is movable into or out of contact with said image carrier.

11. In an image forming apparatus using a process cartridge removably mounted to a body of an image forming apparatus and comprising a casing that accommodates a developing device and at least an image carrier, said developing device comprising:

a developer carrier configured to develop a latent image formed on the image carrier by depositing toner to thereby produce a corresponding toner image;

a toner feeding member rotatable in contact with said developer carrier to thereby feed the toner to said developer carrier;

toner conveying means for conveying the toner toward said toner feeding member;

a metering member contacting said developer carrier and configured to regulate an amount of the toner deposited on a surface of said developer carrier by said toner feeding member; and a regulating member configured to regulate an amount of the toner deposited on a surface of said toner feeding member;

wherein, during development, said developer carrier is rotated such that the surface thereof moves vertically upward at a position where said surface faces an image carrier, while said toner feeding member is rotated such that a surface thereof moves in a same direction as said surface of said developer carrier at a position where said toner feeding member faces said developer carrier, and when said developer carrier is rotated in a direction opposite to a direction for image formation when image formation is not under way, said image carrier and said developer carrier are moved away from each other.

12. The apparatus as claimed in claim 11, wherein said process cartridge comprises a plurality of process cartridges each comprising a respective developing device storing toner of a particular color, whereby toner images of different colors are sequentially transferred to a recording medium one above the other to thereby form a color image.

* * * * *